US005129324A

United States Patent [19]

Campoli

[11] Patent Number: 5,129,324

[45] Date of Patent: Jul. 14, 1992

[54] CARTRIDGE ASSEMBLY

[76] Inventor: Ralph F. Campoli, 25 Alan La., Mine Hill, N.J. 07801

[21] Appl. No.: 644,726

[22] Filed: Jan. 23, 1991

Related U.S. Application Data

[62] Division of Ser. No. 429,461, Oct. 19, 1989, abandoned.

[51] Int. Cl.[5] ..... F42B 5/067; F42B 5/02

[52] U.S. Cl. ..... 102/430; 102/439; 102/470

[58] Field of Search ..... 102/202.5, 204, 205, 102/430, 439, 464, 467, 469, 470, 472, 520, 521

[56] References Cited

U.S. PATENT DOCUMENTS

| | | | |
|---|---|---|---|
| 420,623 | 2/1890 | Holland | 102/430 |
| 3,547,030 | 12/1970 | Kamp | 102/439 |
| 3,955,506 | 5/1976 | Luther et al. | 102/469 |
| 4,458,597 | 7/1984 | Reynes | 102/439 |
| 4,682,545 | 7/1987 | Jett, Jr. | 102/430 |
| 4,763,577 | 8/1988 | Romer et al. | 102/430 |
| 4,917,017 | 4/1990 | Beltz | 102/430 |

FOREIGN PATENT DOCUMENTS

| | | | |
|---|---|---|---|
| 284253 | 5/1915 | Fed. Rep. of Germany | 102/470 |
| 288654 | 4/1920 | Fed. Rep. of Germany | 102/470 |

OTHER PUBLICATIONS

Declaration of Ralph F. Campoli.

*Primary Examiner*—Harold J. Tudor

[57] ABSTRACT

A cartridge assembly is provided, in one embodiment, comprising a combustible casing with an open forward end and an open breech end, enclosed at the breech end by a thin metal stub casing, a projectile assembly mounted in the forward end, an igniter assembly, a resilient obturator pop riveted to the casing, an annular sabot, and a plurality of flexible combustible priming tubes immersed in a propellant charge and extending the length of the casing. In another embodiment, the combustible casing comprises two separate casings joined together with fasteners, each casing having a set of flexible combustible priming tubes, an interface portion defined between the two where respective ends of combustible priming tubes abut. In both embodiments, the priming tubes combust rapidly producing complete ignition of the propellant charge and resultant stable projectile flight.

11 Claims, 7 Drawing Sheets

CARTRIDGE ASSEMBLY

This application is a division of application Ser. No. 07/429,461, filed Oct. 19, 1989.

BACKGROUND OF THE INVENTION

1. Field of the Invention

The present invention relates to a cartridge assembly, and in particular to a cartridge assembly of a projectile for a large-bore gun or a tank-mounted gun.

2. Description of the Related Art

A typical cartridge assembly for a large-bore gun has a cylindrical casing for enclosing the cartridge components, which is made of metal or a combustible material, with a cupped breech end. Fitted over the cupped breech end is a heavy steel stub case, with a rubber gasket to provide a pressure seal between the stub case and a gun barrel. Metal priming tubes filled with a combustible substance extend from an opening in the breech along an entire length of the casing. A propellant charge material is provided in the casing, loaded through an opening in the side of the casing. An igniter head is threaded through a hole in the stub case base, penetrating the cupped breech of the casing to ignite the priming tubes. An open mouth cavity is provided at the forward end of the casing for insertion of an after end of the projectile. The open mouth of the casing is securely affixed to an obturator of the projectile through a number of conventional means, including crimping or cementing.

Several shortcomings have been identified with such a cartridge assembly. Newer projectiles are physically longer and project farther into the casing, requiring use of shorter metal priming tubes. Use of a shorter priming tube has resulted in incomplete ignition of the propellant charge, thereby resulting in uneven pressure changes in the casing produced by incomplete propellant burn, and an erratic pressure differential ($\Delta P$) between the breech and mouth of the casing. Such uneven pressure changes result in erratic motion and balloting of the projectile during its travel down the barrel of the gun, and excessive yaw of the shell after it emerges from the barrel. In a worst case, an excessively large $\Delta P$ (normally 3% to 10% of maximum pressure) can result in deformation of the projectile.

Holes in the typical non-combustible priming tubes are provided for transmitting the ignition spark inside the tube to the propellant. However, if the propellant has settled unevenly in the casing, and an air pocket has formed in the location of a hole, the propellant around that air pocket will not be ignited, further adding to uneven burning of the propellant.

A further shortcoming associated with the prior art is that typical non-combustible priming tubes cannot be used with a double case projectile, having two adjoining casings loaded with propellant, for use in a large-bore gun having a longer than standard chamber. In such a projectile, separate priming tubes with separate igniters are required for each casing. Because of the sequential firing of the holes in the priming tubes, propellant in one casing ignites before the propellant in the other casing. Such non-simultaneous ignition can result in a significant $\Delta P$ which can damage the projectile, or at least result in erratic motion and balloting of the projectile.

A further shortcoming associated with the prior art is the use of the heavy steel stub case, which is expensive to manufacture and difficult to manipulate during gun operations.

A further shortcoming associated with the prior art is the means used to affix the obturator to the casing. Cemented and crimped seals frequently fail during drop tests, so the propellant must be loaded into the casing in bags, in order to prevent propellant grains from spilling out of the casing Propellant loaded in this fashion is further susceptible to uneven loading and uneven burn.

A further shortcoming of the prior art is identified in the manner its design dictates loading the propellant. Because no large opening exists in the casing, the propellant is loaded by hand, in very small amounts. This operation is tedious and time-consuming.

SUMMARY OF THE INVENTION

It is an object of the present invention to provide an improved cartridge assembly which can produce complete ignition of an entire propellant charge, diminished pressure differentials, and subsequent steady flight.

It is also an object of the present invention to incorporate flexible combustible priming tubes loaded with a rapid-burning substance, which can be immersed in the propellant charge and produce instantaneous complete ignition of the propellant.

It is a further object of the present invention to provide an outer combustible casing open at the forward and breech ends for ease of propellant loading and assembly.

It is a further object of the present invention to provide a lighter stub casing which can be manually placed on the open breech end of the combustible casing and easily snapped into place.

It is a further object of the present invention to provide an improved igniter assembly and sabot which can mount and support the flexible priming tubes.

It is a further object of the present invention to provide an improved obturator which can be securely mounted to a forward end of the casing.

It is a further object of the present invention to provide means for translating the flexible combustible priming tubes to a separate casing for creating simultaneous ignition of propellant in a double casing projectile.

Additional objects and advantages of the invention will be set forth in the description, or may be learned by practice of the invention. The objects and advantages of the invention may be realized and obtained by means of the instrumentalities and combinations particularly pointed out in the appended claims.

To achieve the foregoing objects, and in accordance with the purposes of the invention as embodied and broadly described herein, a cartridge assembly is provided, comprising a casing means for housing and supporting the assembly, having a central axis, open at both forward and breech ends, a removable stub casing mounted on the open breech end having a substantially central bore, a projectile assembly coaxially disposed in the open forward end and extending outward from the casing means, igniter means for generating a spark sealingly mounted in the bore of the stub casing and extending coaxially into the casing means, obturator means mounted adjacent the forward end engaging the projectile assembly for fixedly mounting the projectile assembly to the casing means, propellant means for creating a pressure in the casing means, and a plurality of flexible combustible priming tubes operative to ignite the propellant means in response to the generated spark of the igniter means.

There is further provided a cartridge assembly comprising a first casing having a central axis, open at both forward and breech ends, a removable stub casing mounted on the open breech end having a substantially central bore, a first cap portion enclosing the open forward end, having a base with a plurality of apertures penetrating the base, igniter means for generating a spark sealingly mounted in the bore of the stub casing and extending coaxially into the first casing, first propellant means for creating a pressure in the first casing, a first plurality of combustible priming tubes operative to ignite the first propellant means in response to the generated spark of the igniter means, a second casing, having a central axis, open at both forward and breech ends, a projectile assembly coaxially disposed in the open forward end of the second casing and extending out of the second casing, obturator means mounted adjacent the forward end of the second casing engaging the projectile assembly for fixedly mounting the projectile assembly to the second casing, a second cap portion enclosing said open breech end of the second casing, having a base with a plurality of apertures penetrating the base, second propellant means for creating a pressure in the second casing, a second plurality of combustible priming tubes operative to ignite the second propellant means, and means for joining the first cap portion to the second cap portion, the bases of the first and second cap portions defining an interface, the first and second casing being in coaxial alignment.

BRIEF DESCRIPTION OF THE DRAWINGS

The accompanying drawings, which are incorporated in and constitute a part of the specification, illustrate a preferred embodiment of the invention and, together with the general description given above and the detailed description of the preferred embodiment given below, serve to explain the principles of the invention.

DESCRIPTION OF THE PREFERRED EMBODIMENT

Reference will now be made in detail to the present preferred embodiments of the invention as illustrated in the accompanying drawings.

Figure 1:
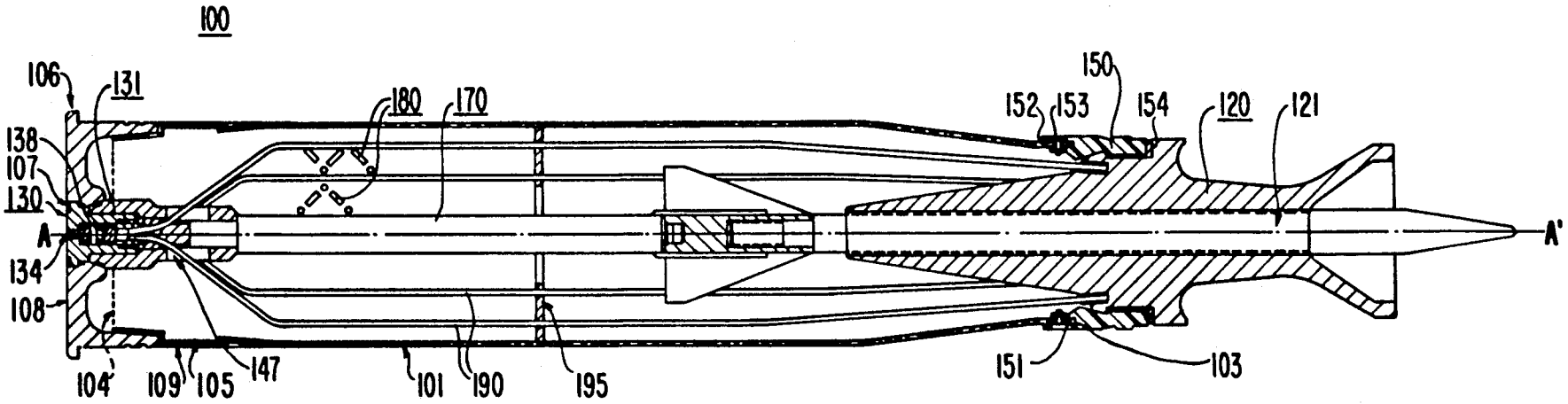
FIG. 1 is a longitudinal sectional view of a cartridge assembly incorporating the teachings of the present invention.
Figure 2:
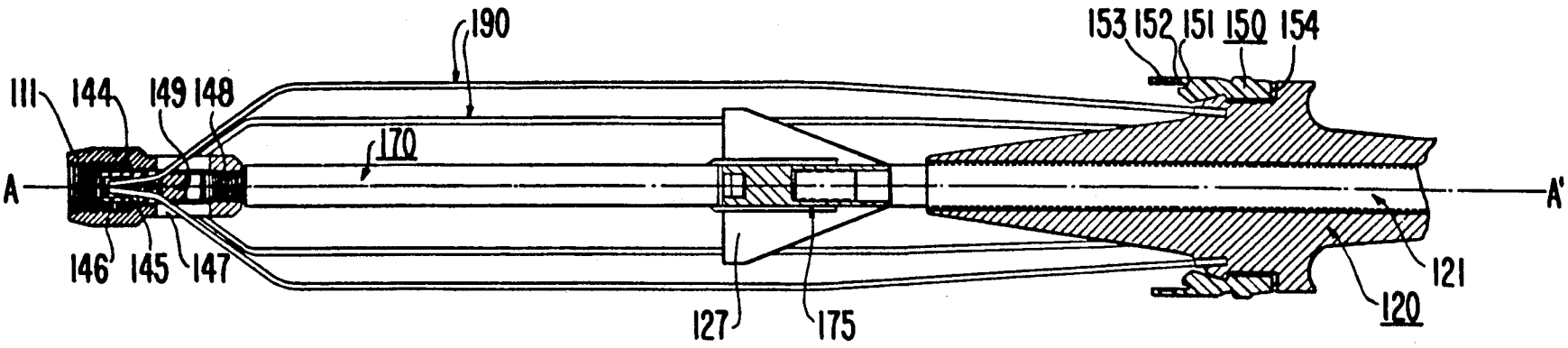
FIG. 2 is a longitudinal sectional view of the cartridge assembly of FIG. 1, prior to the mounting of the outer casing and stub casing.

A first preferred embodiment of a cartridge assembly is shown in FIG. 1, and represented generally by the numeral 100.

According to the present invention the cartridge assembly includes a casing means for housing and supporting the assembly. As embodied in FIG. 1, a generally tubular outer casing, 101, having a central axis A—A', is composed of a combustible material, for example paper or cellulose. Casing 101 is configured preferably with an opening 103 at a forward end thereof, and an opening 104 at a breech end thereof. A raised annular portion 105 encircles the breech opening 104 on an outer circumference of casing 101.

In accordance with the present invention, the cartridge assembly includes a removable stub casing mounted on the open breech end. As embodied herein, a thin, deformable, cylindrical, metallic stub casing 106 having a substantially central bore 107 disposed in a generally circular base 108 is mounted over breech opening 104. An annular indented portion 109 encircles an inner circumference of stub casing 106, disposed and configured to snap over annular raised portion 105, thus fixedly attaching stub casing 106 to casing 101.

The cartridge assembly includes a projectile assembly. A projectile assembly 120, which may be any one of a group of projectiles commonly fired from large-bore guns or tank-mounted guns, which includes a substantially cylindrical penetrator 121, is mounted coaxially in forward opening 103, and extends outward from casing 101.

Preferably, the penetrator is encircled by an annular sabot. As embodied in FIG. 4, sabot 122 is configured with an outer surface penetrated by a plurality of radially spaced slots 123. Each slot 123 is configured with an internal locking clip 124.

In accordance with the invention, the cartridge assembly includes igniter means for generating a spark. Preferably, igniter means include an igniter assembly, spark generating means, an enclosed ignition chamber, and a plurality of radially spaced slots penetrating an outer surface thereof.

Figure 3:
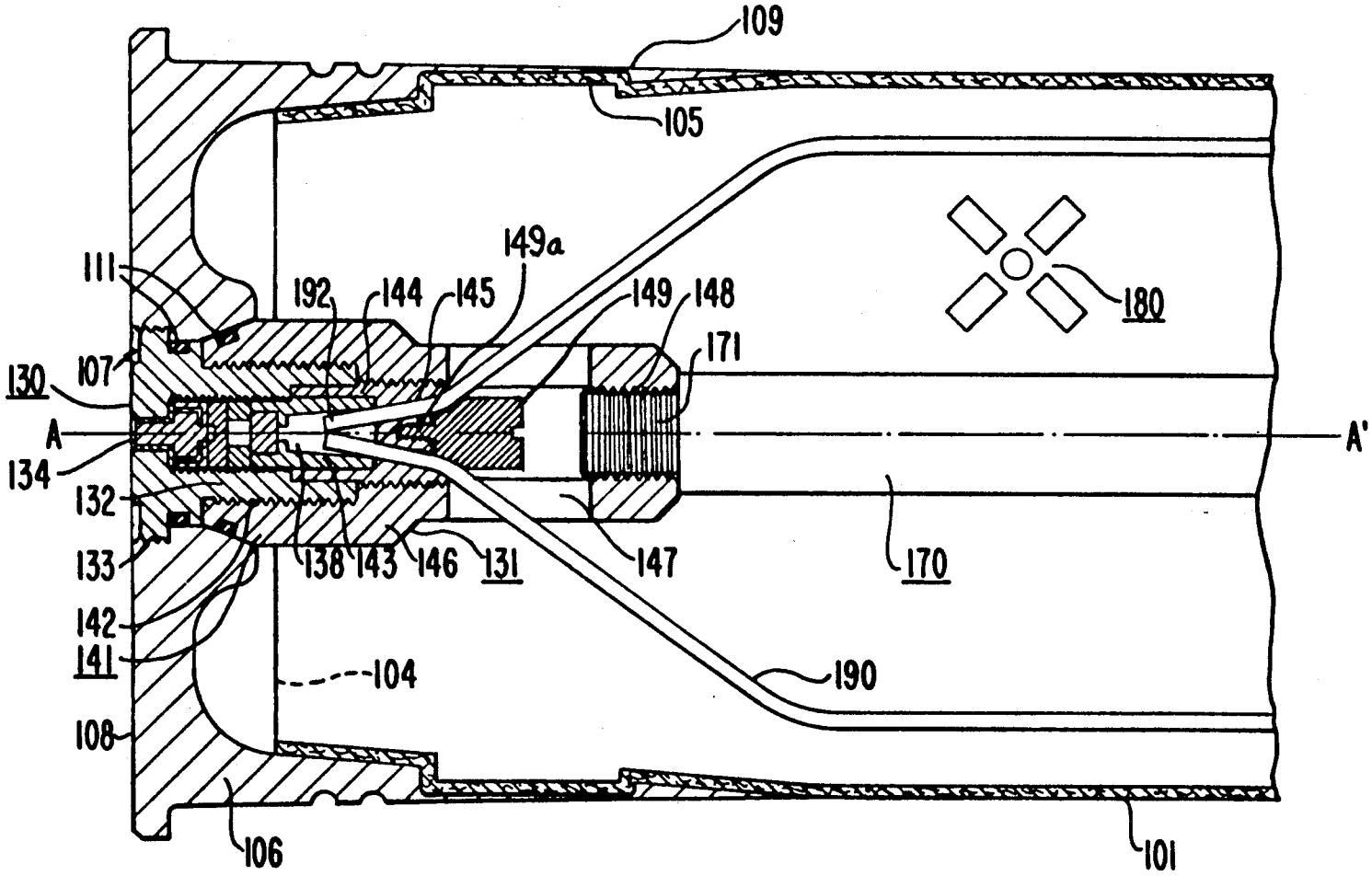
FIG. 3 is a enlarged fragmentary sectional view of the breech portion of the cartridge assembly of FIG. 1.

As embodied in FIG. 3, igniter means 130 includes a substantially cylindrical igniter assembly 131, sealed coaxially in bore 107 with 0-rings 111 to prevent pressure leakage. Preferably, igniter assembly 131 includes the following components. A first igniter head 132 projects coaxially through bore 107, threadably engaged with bore 107 by threads 133. First igniter head 132 encloses a spark generating means 134, which may be, for example, an electrical ignition apparatus or a percussion ignition apparatus, on three sides thereof, with a fourth side open to bore 107. A second igniter head 141 threadably engages first igniter head 132 with threads 142. Preferably second igniter head 141 may include first, second and third igniter bore portions, 143, 144 and 146 respectively, each being generally cylindrical and disposed coaxially in combustible casing 101. First igniter bore portion 143 defines a hollow ignition chamber 138. Partially surrounding first igniter bore portion 143 is second igniter bore portion 144. Second igniter bore portion 144 has external threads, a central threaded blind bore and is penetrated by a plurality of radially spaced holes 145, providing openings to ignition chamber 138. Threadably connected to the external threads of second igniter bore portion 144 is third igniter bore portion 146. Third igniter bore portion 146 is penetrated by a plurality of radially spaced slots 147, disposed in one-to-one alignment with holes 145. Third igniter bore portion 146 includes an opening at its forward end and has an internally threaded portion 148. A retainer cap 149 inserted through the threaded opening has a central threaded stem 149*a* threadably engaging the central threaded blind bore of threaded portion 144.

In accordance with the invention, the cartridge assembly includes obturator means for mounting the projectile assembly to the casing means. As embodied in FIG. 4, obturator means 150 are mounted adjacent forward opening 103 engaging projectile assembly 120 for fixedly mounting projectile assembly 120 in casing 101.

Preferably, obturator means 150 comprises an annular ring of a resilient material, for example nylon, having an after edge and a forward edge. The after edge is configured with a groove 151, disposed to fit over open end 103 of outer casing 101. An extension 152 projects away from groove 151, overlapping open end 103, and is attached to casing 101, preferably with mechanical connectors 153, for example, plastic pop rivets. Obturator means 150 further includes a low-frictional material 154 disposed at the forward edge which provides necessary slipping of obturator means 150 when used in a rifled gun barrel.

The cartridge assembly may include stabilizing means for providing rigidity to the projectile assembly. As embodied in FIGS. 1 and 3, stabilizing means 170 is coaxially mounted in outer casing 101, mechanically connecting projectile assembly 120 to igniter means 130, providing rigidity to projectile assembly 120. Preferably, stabilizing means 170 comprises a cylindrical rod connecting ignition assembly 131 to projectile assembly 120 to provide rigid support thereto during ignition and prior to launching. Stabilizing means 170 includes a threaded after portion 171 for engaging internal threaded portion 148.

Figure 5:
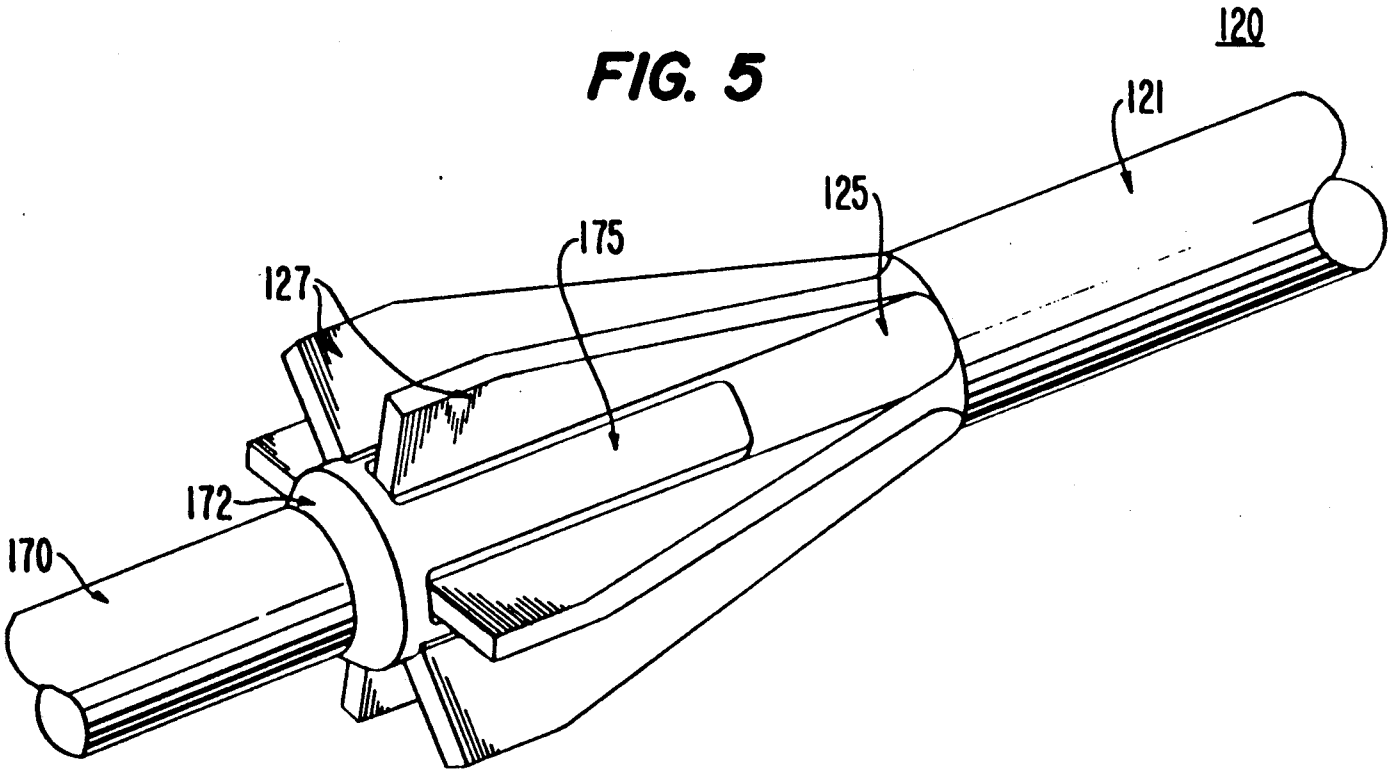
FIG. 5 is an enlarged fragmentary view illustrating a connection of the stabilizing means to an after end of a projectile assembly, in accordance with the teachings of the present invention.

Referring to FIG. 5, projectile assembly 120 includes at an after end of penetrator 121, a hub 125, and a tail fin assembly 126, comprising a plurality of radially spaced individual fins 127. A forward end 172 of stabilizing means 170 separates into a plurality of radially spaced peripheral finger elements 175, slidably inserted over hub 125 to fit between individual fins 127. Finger elements 175 are proximate hub 125. During launch of projectile assembly 120, stabilizing means 170 eliminates any unbalance effects occurring during early ignition while penetrator 121 can pull away from finger elements 175 without any obstruction.

The cartridge assembly includes propellant means for creating a pressure in the casing means. As embodied herein, and referring to FIG. 1, propellant means 180, for example smokeless propellant, is loaded into casing 101 for creating heat and pressure in casing 101 when ignited, sufficient to consume casing 101 and launch projectile assembly 120.

In accordance with the invention, the cartridge assembly includes flexible combustible priming tubes. As embodied herein, and referring to FIG. 1, a plurality of priming tubes 190 are provided, extending the length of casing 101, substantially parallel to central axis A—A'.

Preferably, priming tubes 190 include a plurality of flexible tubes of a combustible material, for example plastic, filled with a rapid burning primer substance, for example nitrous cellulose. Priming tubes 190 extend the length of casing 101, immersed in propellant means 180, and function to ignite propellant means 180. Because the tubes themselves are consumable and loaded with a rapid burning primer substance, total ignition of propellant means 180 can result.

Figure 4:
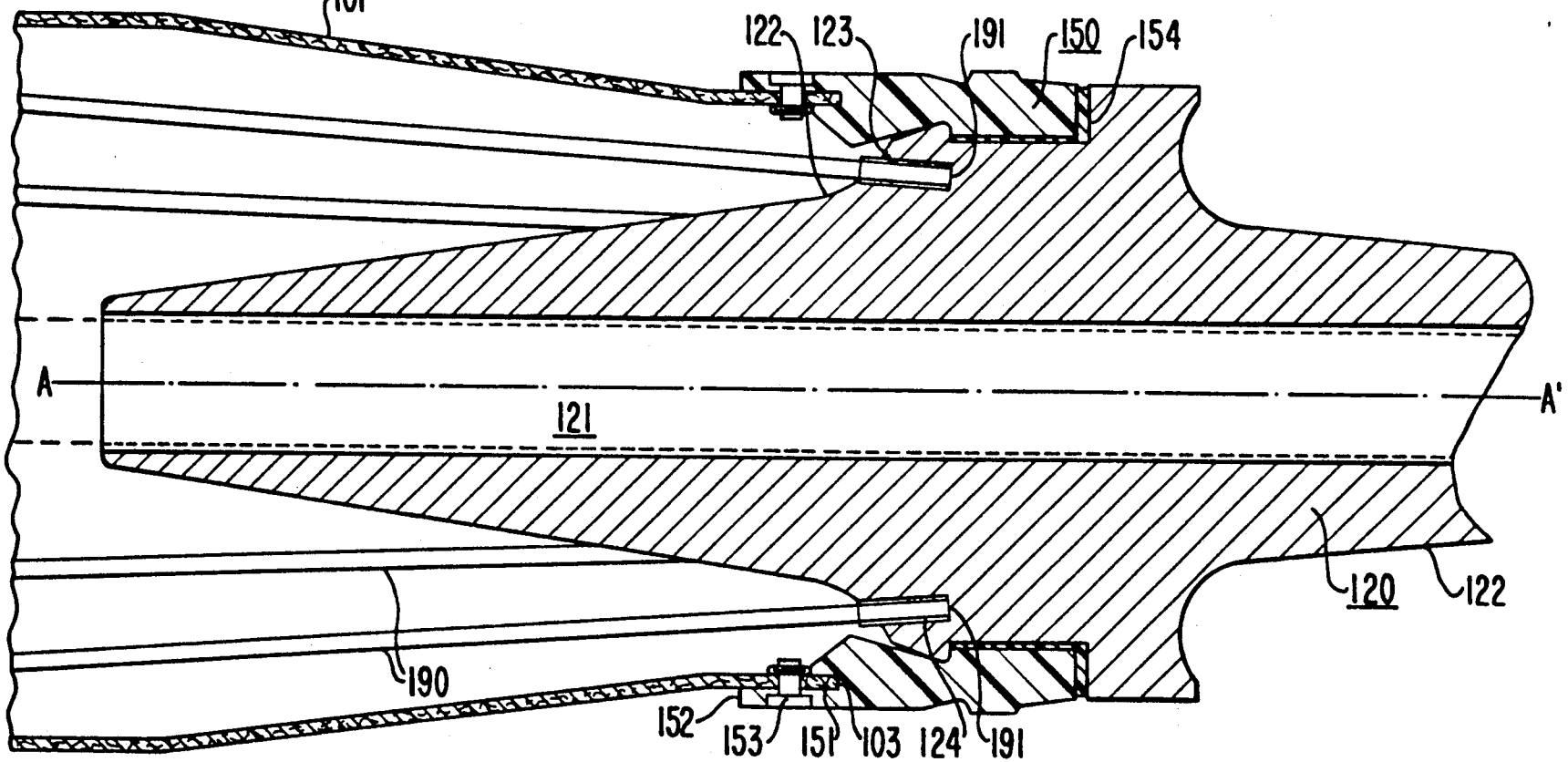
FIG. 4 is an enlarged fragmentary sectional view of a forward portion of the cartridge assembly of FIG. 1.
Figure 6:
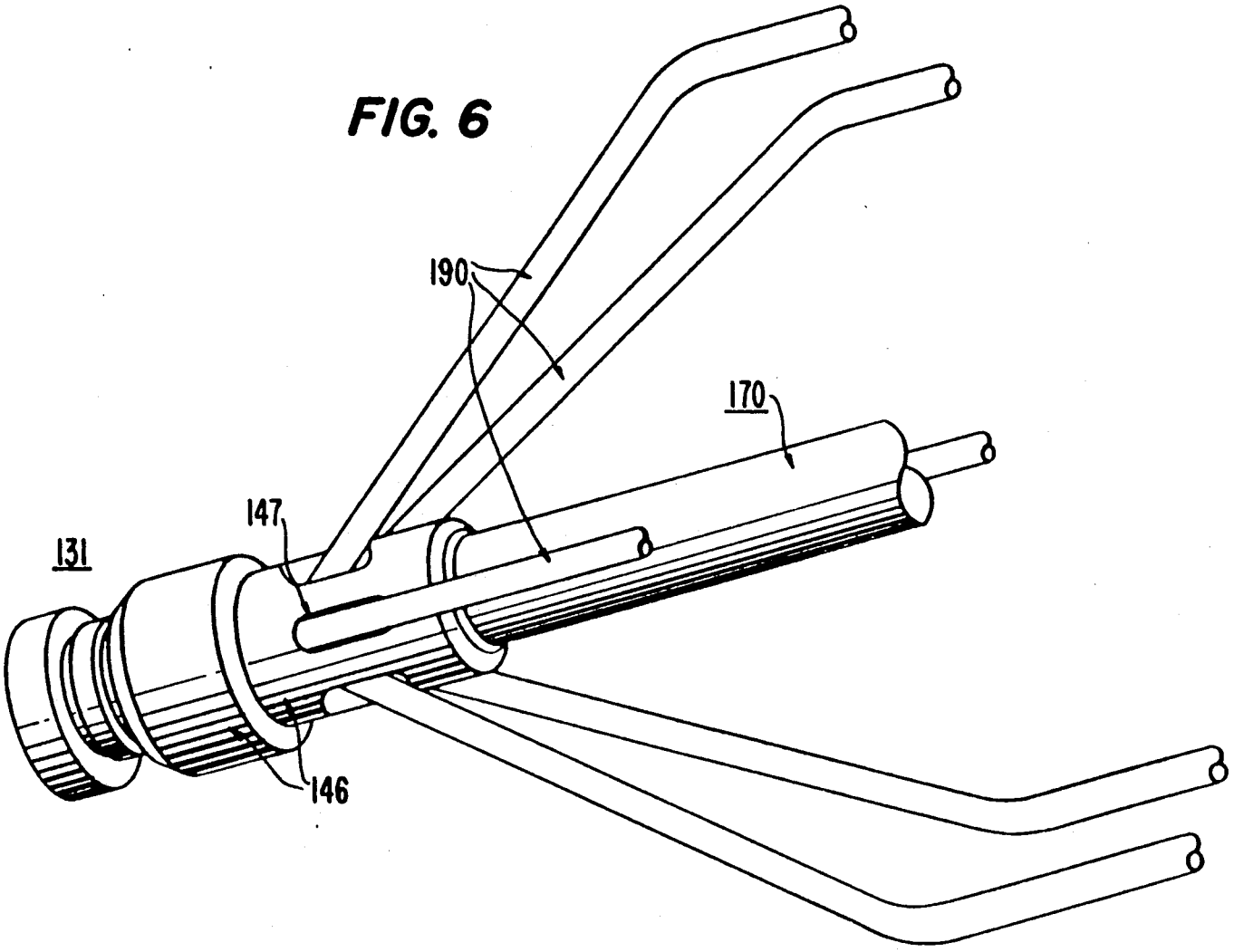
FIG. 6 is an enlarged fragmentary view in perspective illustrating the mounting of after ends of flexible priming tubes in the igniter assembly, in accordance with the teachings of the present invention.

Priming tubes 190 include forward ends 191, which are inserted in slots 123 of sabot 122, and anchored therein with locking clips 124, as shown for example in FIG. 4. Priming tubes 190 further include after ends 192, which are mounted, as shown for example in FIG. 6, penetrating radially spaced slots 147 of igniter assembly 131. Referring again to FIG. 3, it can be seen that after ends 192 further penetrate aligned holes 145 to enter ignition chamber 138. After ends 192 are anchored in this alignment by insertion of retainer cap 149 through internal threaded portion 148 into threaded engagement with the second igniter bore portion 144 so as to clamp the tubes 190 therebetween thereby confining the priming tubes 190 in second igniter bore portion 144 and the ends 192 in the ignition chamber 138.

Preferably, the cartridge assembly further include means for supporting the priming tubes in the casing means. As embodied herein, and shown at FIG. 1, at least one generally star-shaped flat support plate 195 is inserted in casing 101, engaging the inner perimeter of casing 101 in a plurality of locations, configured with a plurality of apertures through which priming tubes 190 pass. Thus, priming tubes 190 are supported in the casing and kept out of physical contact with one another.

The first preferred embodiment operates in the following manner. Spark generating means 134 generates a spark in ignition chamber 138, igniting after ends 192 of priming tubes 190. Combustible priming tubes 190 rapidly burn along their entire length, thereby completely igniting propellant means 180 to rapidly generate heat and pressure. Combustible casing 101 is consumed by the heat, and metallic stub casing 106 is deformed outwardly against an after portion of a gun barrel thus creating a pressure tight breech seal. Simultaneously, resilient obturator means 150 is deformed outwardly against a forward portion of the gun barrel to provide a pressure-tight forward seal. At a predetermined pressure, penetrator 121 is launched forward, hub 125 being released instantaneously from the grip of finger elements 175. Immediately following total ignition of propellant means 180, total chamber pressure has reached equilibrium, thereby resulting in uniform pressure loads throughout the chamber.

In accordance with the invention, total ignition of propellant means 180 due to complete combustion of priming tubes 190 occurs without pressure fluctuations or $\Delta P$. The combination of the elements broadly described herein produces a launch of penetrator 121 with substantially reduced balloting within the gun barrel and reduced yaw of projectile 121 in flight.

Figure 7:
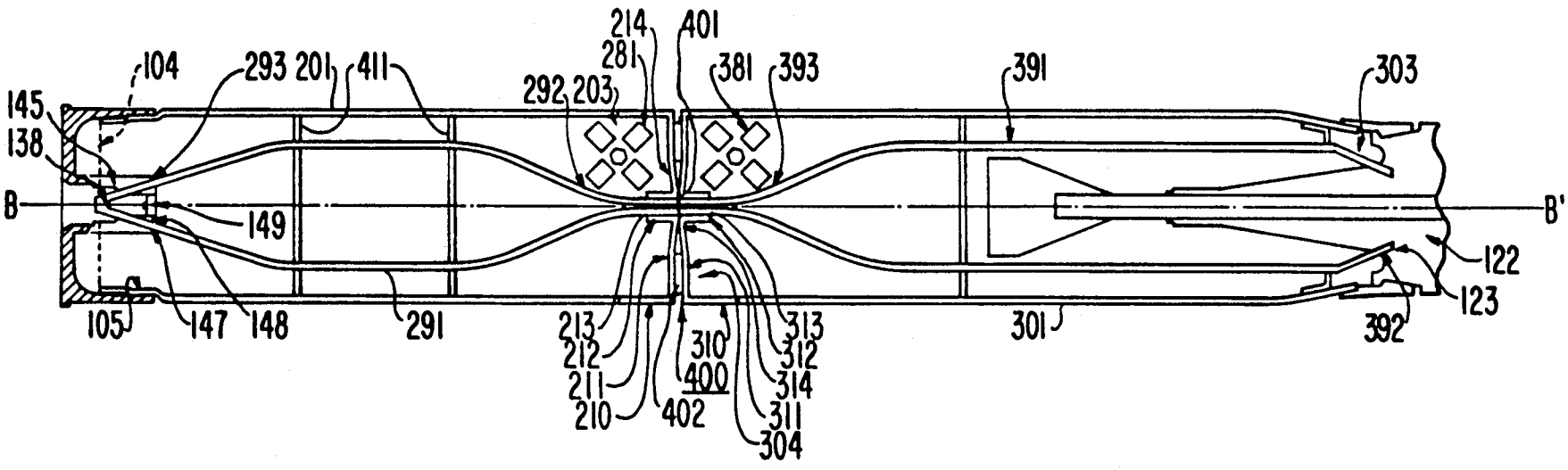
FIG. 7 is a longitudinal sectional view of a double casing cartridge assembly incorporating the teachings of the present invention.

A second preferred embodiment of a cartridge assembly incorporating the teachings of the present invention is shown in FIG. 7, and represented generally by the numeral 200. In the second embodiment, like components are numbered correspondingly, and shall not be repeated.

According to the present invention, the cartridge assembly of the second embodiment includes a first casing. As embodied in FIG. 7, a generally tubular first casing 201, having a central axis B—B', is composed of a combustible material, for example paper or cellulose. First casing 201 is configured preferably with an opening 203 at a forward end thereof, and an opening 104 at a breech end thereof. A raised annular portion 105 is disposed on an outer circumference of first casing 201.

In accordance with the invention, the cartridge assembly of the second embodiment includes a first cap portion enclosing the open forward end of the first casing. As embodied herein, and referring to FIG. 7, a generally cylindrical, generally cuplike first cap portion 210 fits over forward end 203 of first casing 201, sealing the open end. First cap portion 210 is made of a combustible material, for example, of paper, and is fixed to first casing 201 with a sealant, for example, glue.

First cap portion 210 has a generally circular base 211, having a substantially central annular inner wall 212, extending into first casing 201. A plurality of apertures 213 penetrate the base 211 within the perimeter of annular wall 212. As shown in FIG. 7, base 211 preferably includes a central raised portion 214, in the vicinity of annular wall 212.

The cartridge assembly of the second embodiment includes first propellant means for creating a pressure in the first casing. As embodied herein, and shown in FIG. 7, first propellant means 281, for example smokeless propellant, are loaded into first casing 201.

In accordance with the invention, the cartridge assembly of the second embodiment includes a first plurality of pliable combustible priming tubes. As embodied herein, and referring to FIG. 7, a first plurality of priming tubes 291 are provided, extending the length of first casing 201, substantially parallel to central axis B—B'. Preferably, first plurality of priming tubes 291 includes a plurality of flexible tubes of a combustible material, for example plastic, filled with a rapid burning substance, for example nitrous cellulose. Priming tubes 291 extend the length of first casing 201, immersed in first propellant means 281, and function to ignite first propellant means 281. Because the tubes are combustible, total ignition of first propellant means 281 can result.

First priming tubes 291 include forward ends 292, which are inserted in apertures 213 of first cap portion 210, to be flush with base 211. First priming tubes 291 further include after ends 293, which are mounted in radially spaced slots 147 of igniter assembly 131. After ends 293 further penetrate aligned holes 145 to enter ignition chamber 138. After ends 293 are anchored in this alignment by engagement of retainer cap 149 with internal threaded portion 148.

In accordance with the invention, the cartridge assembly of the second embodiment includes a second casing. As embodied herein, and referring to FIG. 7, generally tubular second casing 301, having a central axis B—B' which is coaxial with central axis B—B' of first casing 201, is composed of a combustible material, for example paper or cellulose. Second casing 301 is configured preferably with an opening 303 at a forward end thereof, and an opening 304 at a breech end thereof.

In accordance with the invention, the cartridge assembly of the second embodiment includes a second cap portion, enclosing the open breech end of the second casing. As embodied herein, and referring to FIG. 7, a generally cylindrical, cuplike combustible second cap portion 310 fits over breech end 304 of second casing 301, sealing the open end. Second cap portion 310 is made of, for example, paper and is fixed to second casing 301 with a sealant, for example, glue.

Second cap portion 310 has a generally circular base 311, having a substantially central annular inner wall 312 extending into second casing 301. A plurality of apertures 313 penetrate the base 311 within the perimeter of annular wall 312. Preferably, base 311 includes a central raised portion 314 in the vicinity of annular wall 312.

The cartridge assembly of the second embodiment includes second propellant means for creating a pressure in the second casing. As embodied herein, and shown at FIG. 7, second propellant means 381, for example smokeless propellant, ignite to create a pressure in second casing 301 simultaneously with ignition of first propellant means 281 in first casing 201.

In accordance with the invention, the cartridge assembly of the second embodiment includes a second plurality of pliable combustible priming tubes. As embodied herein, and shown at FIG. 7, a second plurality of priming tubes 391 are provided extending the length of second casing 301. This second plurality of priming tubes 391 is comprised of the same material and has the same physical configuration as the first plurality of priming tubes 291. Forward ends 392 are fixedly inserted in radially spaced slots 123 of sabot 122. After ends 393 are inserted in apertures 313 of second cap portion 310, to be flush with base 311.

In accordance with the invention, the cartridge assembly of the second embodiment includes a means for joining the first cap portion to the second cap portion. As embodied herein, and referring to FIG. 7, joining means 400 joins together first cap portion 210 and second cap portion 310, with central raised portions 214 and 314 respectively abutting one another to form a fixed interface 401. The two casings 201 and 301 are thus joined in coaxial alignment. At interface 401, forward ends 292 of first plurality of priming tubes 291 abut against after ends 393 of second plurality of priming tubes 391.

Preferably, joining means 400 includes a plurality of fasteners 402, for example but not by way of limitation, clips or velcro strips, capable of maintaining fixed interface 401 between the first and second casing 201 and 301 respectively, and maintaining abutment of first priming tubes 291 with second priming tubes 391.

Preferably, the cartridge assembly of the second embodiment further includes a means for supporting the priming tubes. As embodied in FIG. 7, supporting means includes at least one generally flat generally star-shaped support plate 411 in each casing, disposed generally perpendicular to the central axis, first and second combustible tubes 291 and 391 extending through apertures in said plates 411 in order to receive lateral support and be kept out of physical contact with one another.

The second preferred embodiment operates substantially as described below. Second casing 301, having penetrator 121 projecting from forward end 303, is loaded into a gun barrel. First casing 201 is loaded thereafter. Joining means 400 engages to hold first and second cap portions 210 and 310 abutting one another to form interface 401 therebetween, with first and second priming tubes 291 and 391 abutting at interface 401. As the breech door of the gun is closed, first and second cap portions 210 and 310 may be compressed together to further ensure interface 401 remains fixed, thereby maintaining abutment of forward ends 292 of priming tubes 291 and after ends 393 of priming tubes 391. This type of connection also permits simultaneous extraction of both charges.

Spark generating means 134 generates a spark in ignition chamber 138, igniting after ends 292 of first priming tubes 291. First priming tubes 291 rapidly and completely burn along their entire length. At interface 401, second priming tubes 391 ignite, and rapidly and completely burn along their entire length. Due to the rapidity and completeness with which the combustible priming tubes burn, first and second propellant means, 281 and 381 combust substantially simultaneously, producing heat which totally consumes first and second casings 201 and 301, and pressure without any noticeable ΔP caused by the separate explosions. Metallic stub casing 106 expands outwardly, creating a pressure tight breech seal in the after portion of the gun barrel. Simultaneously, obturator means 150 deforms outwardly, providing a pressure tight forward seal. At a predetermined pressure, penetrator 121 is launched forward.

In accordance with the invention, the total ignition of the first and second propellant means due to rapid complete combustion of the first and second plurality of priming tubes creates a uniform pressure without fluctuations or a large ΔP. Therefore, even with a cartridge having a double casing, the penetrator is launched with reduced balloting and reduced subsequent projectile yaw.

Further, in accordance with the present invention, the preferred embodiments provide for an easy method of assembly and propellant loading, which adds to the complete spontaneous ignition of the propellant means 180. Because combustible casings 101, 201 and 301 include open breech ends, the preferred embodiments can be assembled with open breech ends pointing substantially vertically upwards. The components can be installed sequentially into the casing. Preferably, the propellant means can be loaded through the open breech mouth of each casing to substantially fill the combustible casing and immerse the flexible priming tubes, without presence of air gaps in the vicinity of the priming tubes. The improved opturator seal is not susceptible to failure and spill of propellant grains. The lighter stub case is easy to manipulate. The entire assembly, which results from the unique combination of elements and improvements preferably included in the present invention, is thus a comparatively simple process.

Additional advantages and modifications will readily occur to one skilled in the art. The invention in its broader aspects is therefore not limited to the specific details, representative apparatus, and illustrative examples shown and described. Accordingly, departures may be made from such details without departing from the spirit of the applicant's general inventive concept.

What is claimed is:

1. A cartridge assembly comprising:

a casing means having a central axis and having open forward and breech ends for housing a propellant charge and supporting a projectile assembly coaxially disposed in the open forward end extending outward from said casing means and having a rear portion extending substantially into said casing means;

a stub casing mounted on said open breech end, said stub casing having a substantially central bore therethrough; and an igniter means for generating a spark sealingly mounted in the bore of the stub casing and extending coaxially into the casing means comprising an igniter assembly having a first portion extending into said bore and engaging part of said stub casing and a second portion abutting an inner surface of said sub casing, said second portion being mounted on said rear end of said projectile assembly, said portions coating together to engage and clamp said igniter assembly to said stub casing, seal said bore in said stub casing and close said breech end, said second igniter portion comprising a cylindrical first bore portion defining a hollow ignition chamber therein, a second igniter bore portion coaxially disposed onto said first bore portion and having at least one through hole opening into said chamber, and a third igniter bore portion coaxially over said first and second bore portions.

2. The cartridge assembly according to claim 1 wherein said projectile assembly comprises an axially disposed elongated penetrator, a sabot encircling and gripping the penetrator and a stabilizing rod having a forward end thereof releasably attached to a rear end of the penetrator and a rear end attached to said second portion of said ignitor assembly.

3. The cartridge assembly according to claim 1 wherein said second portion of said igniter assembly has a tapered annular end surface abutting a corresponding tapered annular inner surface of said stub casing in said bore.

4. The cartridge assembly according to claim 3 further comprising a flexible annular seal disposed between said annular surface of said stub casing in said bore and said second portion to form a compressive seal therebetween.

5. A cartridge assembly comprising:

a casing means having a central axis and having open forward and breech ends for housing a propellant charge and supporting a projectile assembly coaxially disposed in the open forward end extending outward from said casing means and having a rear portion extending substantially into said casing means;

a stub casing mounted on said open breech end, said stub casing having a substantially central bore therethrough;

an igniter means for generating a spark sealingly mounted in the bore of the stub casing and extending coaxially into the casing means comprising an igniter assembly having a first portion extending into said bore engaging part of said stub casing and a second portion abutting an inner surface of said stub casing, said second portion being mounted on said rear end of said projectile assembly, said portions coacting together to engage and clamp said igniter assembly to said stub casing, seal said bore in said stub casing and close said breech, said projectile assembly comprising an axially disposed elongated penetrator, a sabot encircling and gripping the penetrator and a stabilizing rod having a forward end thereof releasably attached to a rear end of the penetrator and a rear end attached to said second portion of said igniter assembly, said second portion of said igniter assembly having a tapered annular end surface abutting a corresponding tapered annular inner surface of said stub casing in said bore; and a flexible annular seal member disposed between said annular surface of said stub casing in said bore and said second portion to form a compressive seal therebetween;

said second igniter portion comprising a cylindrical first bore portion defining a hollow ignition chamber therein, a second igniter bore portion coaxially disposed onto said first bore portion and having at least one through hole opening into said chamber, and a third igniter bore portion coaxially over said first and second bore portions.

6. The cartridge assembly according to claim 5 wherein said third bore portion threadably engages with said stabilizing rod and said first igniter portion to mechanically fasten the stabilizer rod to said stub casing.

7. The cartridge assembly according to claim 5 wherein said forward end of said stabilizing rod is slidably mounted to the rear end of said penetrator.

8. The cartridge assembly according to claim 7 wherein said forward end of said stabilizing rod has a plurality of axially extending fingers engaging the rear end of the penetrator to prevent lateral movement of said penetrator while permitting axial movement of said penetrator away from said stabilizing rod.

9. The assembly according to claim 5 wherein said at least one hole through said second igniter bore portion is adapted to receive one end of a flexible combustible priming tube.

10. The assembly according to claim 5 wherein said second igniter bore portion has a plurality of holes opening into said chamber, each adapted to receive an end of a flexible combustible priming tube.

11. The assembly according to claim 10 wherein said third igniter bore portion has a plurality of slots, each aligned with one of said holes through said second bore portion and adapted for passage therethrough of one of said flexible combustible priming tubes.

* * * * *

UNITED STATES PATENT AND TRADEMARK OFFICE

CERTIFICATE OF CORRECTION

PATENT NO. : 5,129,324

DATED : July 14, 1992

INVENTOR(S) : Ralph F. Campoli

It is certified that error appears in the above—identified patent and that said Letters Patent is hereby corrected as shown below:

In column 10, line 23 after "seal" insert --member--.

Signed and Sealed this

Fourteenth Day of September, 1993

Bruce Lehman

*Attest:*

BRUCE LEHMAN

*Attesting Officer*

*Commissioner of Patents and Trademarks*